US007309251B2

(12) United States Patent
Narita

(10) Patent No.: US 7,309,251 B2
(45) Date of Patent: Dec. 18, 2007

(54) CONNECTION CONTACT OF AN ELECTRIC CONNECTOR

(75) Inventor: Kenji Narita, Tokyo (JP)

(73) Assignee: I-PEX Co. Ltd., Machida-shi (JP)

( * ) Notice: Subject to any disclaimer, the term of this patent is extended or adjusted under 35 U.S.C. 154(b) by 0 days.

(21) Appl. No.: 11/358,500

(22) Filed: Feb. 21, 2006

(65) Prior Publication Data

US 2006/0205290 A1 Sep. 14, 2006

(30) Foreign Application Priority Data

Feb. 21, 2005 (JP) ..... 2005-044139

(51) Int. Cl.
*H01R 4/50* (2006.01)

(52) U.S. Cl. ..... 439/387; 200/279

(58) Field of Classification Search ..... 439/884, 439/387; 200/279, 253

See application file for complete search history.

(56) References Cited

U.S. PATENT DOCUMENTS

| | | | | |
|---|---|---|---|---|
| 2,000,909 | A * | 5/1935 | Alsaker | 29/863 |
| 2,036,759 | A * | 4/1936 | Kleinmann | 439/825 |
| 2,114,523 | A * | 4/1938 | Cleveland | 337/251 |
| 3,337,834 | A * | 8/1967 | Godwin et al. | 439/497 |
| 3,659,247 | A * | 4/1972 | Chaney et al. | 439/32 |
| 3,858,956 | A * | 1/1975 | Garrett | 439/106 |
| 4,662,706 | A * | 5/1987 | Foley | 439/851 |
| 5,186,665 | A * | 2/1993 | Kelly et al. | 439/862 |
| 6,077,131 | A * | 6/2000 | Fukuda et al. | 439/884 |
| 6,338,632 | B1 * | 1/2002 | Jones | 439/82 |

* cited by examiner

*Primary Examiner*—Neil Abrams
(74) *Attorney, Agent, or Firm*—Reed Smith LLP

(57) ABSTRACT

A groove is formed on a connecting section surface of an electrically conductive terminal, this groove is subjected to a bending deformation into a convex shape toward the surface side from the backside of a connecting section to form a bent convex section on the surface of the connecting terminal, and edge sections formed on both sides of this groove are positioned on the surface of the bent convex section. When joined to a counterpart connecting section, the groove edge sections are displaced to approach one another to provide a wiping effect on the surface of the counterpart connecting section.

4 Claims, 5 Drawing Sheets

CONNECTION CONTACT OF AN ELECTRIC CONNECTOR

BACKGROUND OF THE INVENTION

1. Field of the Invention

The present invention relates to an electric connector. More specifically, it relates to an electric connector for the connection of a substrate and another substrate or a cable and a substrate. In particular, it relates to an improvement in connecting terminals provided inside these electric connectors.

2. Description of the Related Art

Conventionally, as an electric connector (a plug connector or a receptacle connector) for the connection of a substrate and another substrate or a cable and a substrate, a variety of materials have been used. With these electric connectors, electric connection between electric connectors has been attempted via connecting terminals provided inside them.

On the other hand, with the electric connector described previously, if foreign substances or the like adhere to the connecting sections (direct contact portions) of the connecting terminals provided inside them, damage to the electric connection between this connecting section and the connecting section of the other connecting terminal subjected to pressure adherence on this connecting section can result.

Here, in order to reliably maintain the good electric connection between various connecting terminals between electric connectors, conventionally, on one connecting section of the connecting terminal, press processing or other processing is carried out from its backside and a convex protrusion (a pimple) is formed on its surface. The protrusion is contacted by the connecting section of the other connecting terminal, and foreign substances adhered to the connecting section are eliminated. In doing so, good electric connection between various connecting terminals has been attempted.

However, in this conventional case, since it is difficult to form the protruded front end into a sharp form, there is a tendency for the foreign substance elimination to not be successful. There is a difficulty in that a stable electric connection cannot be obtained.

Furthermore, conventionally, as shown in the major portion cross-sectional diagram of FIG. 9, there is a case in which a V-shaped groove (4) or a concave section is formed on the connecting section surface (3) of one of the connecting terminals (1), and the connecting section surface (5) of the other connecting terminal (2) is formed into a circular arc shape (an R shape).

In such a conventional case, the connecting section surface (5) of the other connecting terminal (2) contacts the connecting section surface (3) with the formation of a V-shaped groove (4) of the one connecting terminal (1), in edge sections (4*a*) (edge line portions) of the V-shaped groove (4), and the other connecting section surface (5) in the circular arc shape is pulled to remove foreign substances (so-called wiping effect). As a result, with the edge sections (4*a*) mentioned previously as the points of contact, a stable electric connection between the various connecting terminals (1) and (2) can be obtained (please refer to FIG. 13 and FIG. 14 in Japanese Kokai Patent Application No. 2004-111081).

However, with the conventional structures of the various connecting section surfaces (3) and (5) of the connecting terminals (1) and (2) as shown in FIG. 9, it is necessary that a V-shaped groove (4) be formed on the connecting section surface (3) of one of the connecting terminals (1) and that the connecting section surface (5) of the other connecting terminal (2) be formed into a circular arc shape. Therefore, the number of processes for the manufacture of the connecting terminals is increased and this becomes a major cause of increased cost.

SUMMARY OF THE INVENTION

In view of the things described previously, the present invention has an objective to provide a connecting terminal of an electric connector so that the manufacturing cost is low and so that stable electric connection characteristics can be obtained.

In order to solve the problems described previously, in the first invention of the present application, in the connecting terminal of an electric connector having an electrically conductive terminal, a groove is formed on the connecting section surface of the electrically conductive terminal mentioned previously, said groove is subjected to a bending deformation into a convex shape toward the surface side from the backside of the connecting section mentioned previously to form a bent convex section on the surface of the connecting section mentioned previously, and the edge sections formed on both sides of the groove mentioned previously are positioned on the surface of the bent convex section mentioned previously.

Furthermore, in the second invention of the present application, in the connecting terminal of an electric connector having an electrically conductive terminal, a long hole is formed on the connecting section surface of the electrically conductive terminal mentioned previously, said long hole is subjected to a bending deformation into a convex shape toward the surface side from the backside of the connecting section mentioned previously to form a bent convex section on the surface of the connecting section mentioned previously, and the edge sections formed on both sides of the long hole mentioned previously are positioned on the surface of the bent convex section mentioned previously.

With the connecting terminal of the electric connector of the present invention described previously, a groove or a long hole is formed on the surface of the connecting section, said groove or long hole is subjected to a bending deformation into a convex shape toward the surface side from the backside of the connecting section mentioned previously to form a bent convex section, and the pair of the edge sections (the edge line sections) formed on both sides of this groove or long hole are positioned on the surface of the bent convex section. Therefore, if the other connecting terminal in a flat plate is subjected to pressure contacting on this bent convex section, the one pair of edge sections of said groove or long hole is displaced so that the edge sections are mutually adjacent to each other on the surface of the other connecting terminal subjected to pressure contacting mentioned previously. Therefore, the one pair of edge sections of said groove or long hole scratches the surface of the counterpart connecting section to remove foreign substances (so-called wiping effect). With this pair of edge sections as the points of contact, stable electric connection characteristics between the two connecting terminals can be maintained reliably.

In order to reliably maintain such stable electric connection characteristics, it is acceptable to form a bent convex section having a groove or a long hole described previously on the connecting terminal of one of the electric connectors in a pair of electric connectors to be mutually connected. Therefore, the process for the manufacture of the connecting terminals is simplified. Connecting terminals of electric connectors that have a low cost and that are capable of maintaining stable electric connection characteristics can be provided.

DETAILED DESCRIPTION OF THE DRAWINGS

An application example of a connecting terminal of an electric connector related to the present invention will be described in detail in the following.

Figure 1:
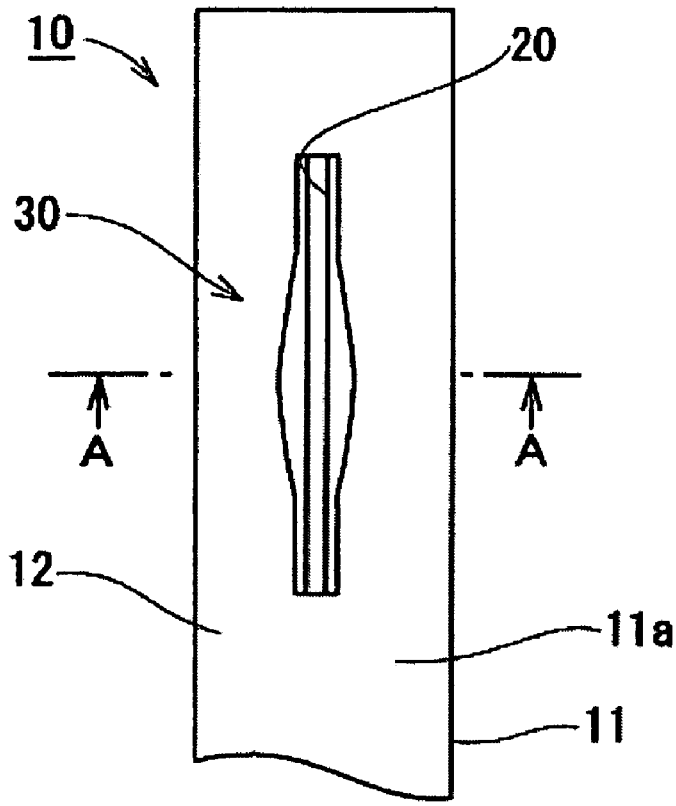
FIG. 1 is a major portion cross-sectional planar diagram of an electrically conductive terminal related to the present invention.

FIG. 1 is a major portion cross-sectional planar diagram of the connecting section (11) of a connecting terminal (10) related to the present invention.

The base material of this connecting section (11) originally consists of a smooth flat plate (12). In the center of its surface (11*a*), a groove (20) is formed in the longitudinal direction.

Figure 2:
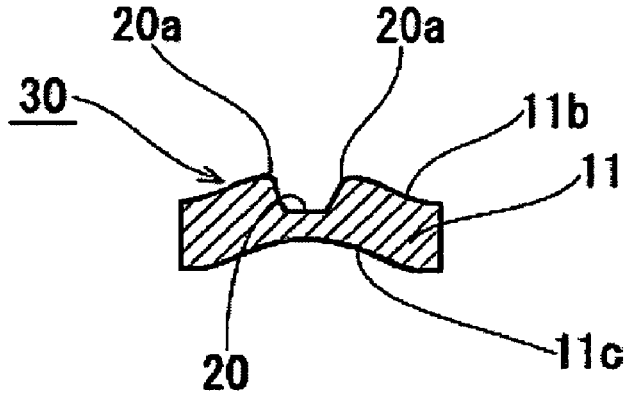
FIG. 2 is the A-A cross-sectional diagram of FIG. 1.

The circumference of this groove (20), in the manner shown in FIG. 2 of the AA cross section of FIG. 1, is subjected to a bending deformation into a convex shape from the backside (11*c*) of the connecting section (11) toward the surface (11*b*) side. Here, a bent convex section (30) is formed. In other words, a pair of edge sections (20*a*) (the edge line portions) formed on both sides of the groove (20) mentioned previously is provided on the surface of the bent convex section (30) described previously.

Figure 3:
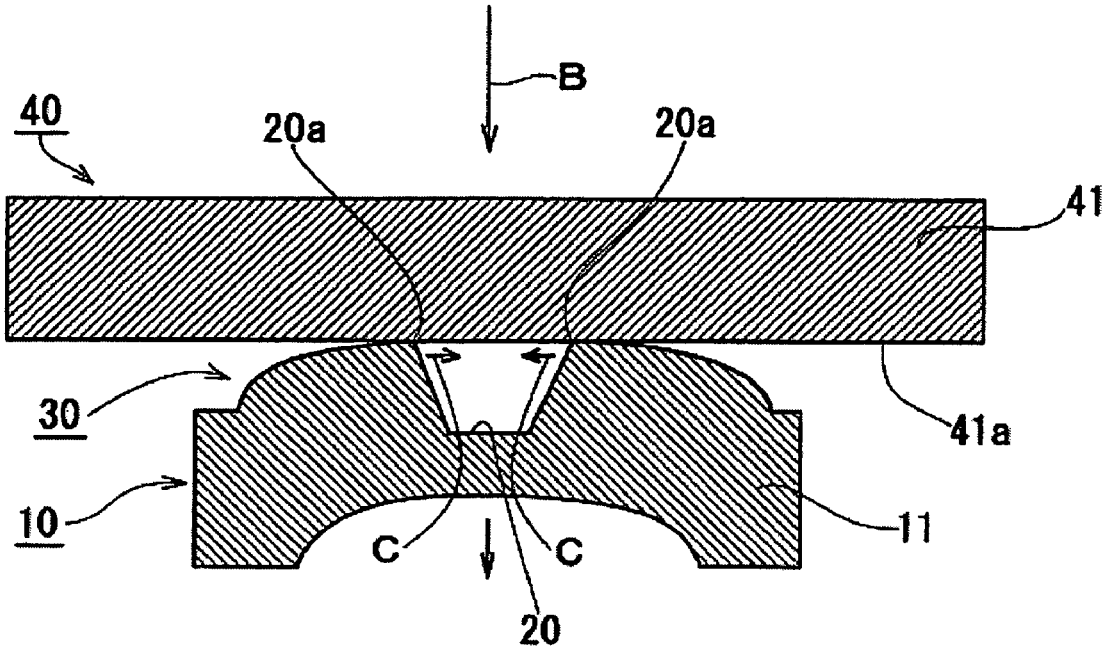
FIG. 3 is a major portion conceptual, enlarged cross-sectional diagram showing the actions of an electrically conductive terminal related to the present invention.

With the connecting terminal (10) of the structure described previously, with respect to the groove (20) of the bent convex section (30) as shown by arrow B in FIG. 3, the connecting section (41) of the other connecting terminal (40) as a flat plate is subjected to pressure contacting. If the bent convex section (30) is pushed from above toward below to cause deformation in this manner, as shown by arrows C, the pair of edge sections (20*a*) and (20*a*) of the groove (20) is displaced so that the edge sections are mutually adjacent to each other on the surface (41*a*) of the other connecting section (41) subjected to pressure contacting. Therefore, each edge section (20*a*) of the pair mentioned previously scratches the surface (41*a*) of the counterpart connecting section (41) to remove foreign substances (the so-called wiping effect). With the pair of the edge sections (20*a*) as the points of contact in this manner, stable electric connection characteristics between the two connecting terminals (10) and (40) can be maintained reliably.

Figure 4:
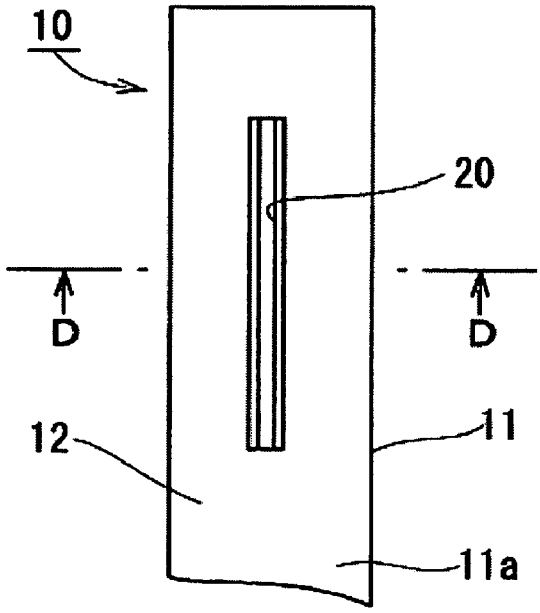
FIG. 4 is a major portion cross-sectional planar diagram showing the manufacturing method for an electrically conductive terminal related to the present invention.
Figure 5:
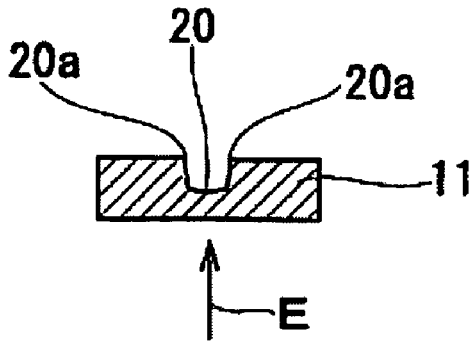
FIG. 5 is the D-D cross-sectional diagram of FIG. 4.

In order to form the bent convex section (30) described previously, as shown in the planar diagram in FIG. 4, on the surface (11*a*) of a smooth flat plate (12) of the connecting section (11), a groove (20) is formed centrally in the longitudinal direction. Afterwards, press processing is carried out from the arrow E direction of FIG. 5 shown by the DD cross section of FIG. 4. With such simple processing, the bent convex section (30) shown in FIG. 2 is formed.

Figure 6:
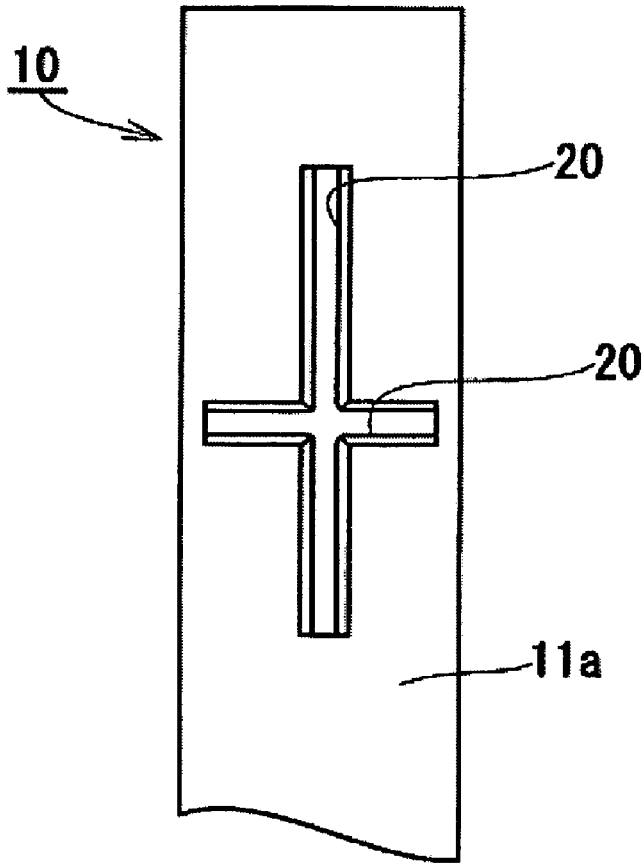
FIG. 6 is a major portion cross-sectional planar diagram showing another application example of an electrically conductive terminal related to the present invention.
Figure 7:
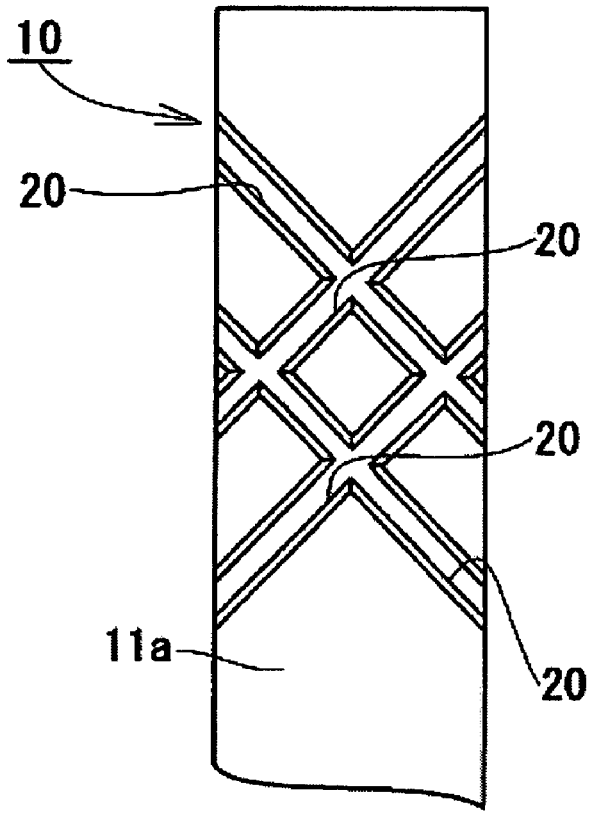
FIG. 7 is a major portion cross-sectional planar diagram showing another application example of an electrically conductive terminal related to the present invention.

In the application example described previously, on the surface (11*a*) of the smooth flat plate (12) of the connecting section (11), the groove (20) is formed centrally in the longitudinal direction. However, the shape of the groove (20) described previously is not restricted to the application example mentioned previously. In the manner of FIG. 6 showing the same portions as in FIG. 4 by the same symbols, the groove may also be formed into a cross shape on the connecting section surface (11*a*). Furthermore, as shown in FIG. 7, it may also be formed into a roulette shape, and its planar shape is not restricted.

Figure 8:
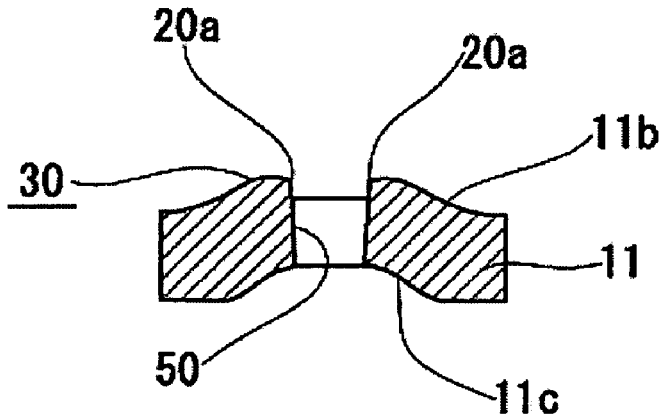
FIG. 8 is a major portion cross-sectional diagram showing another application example of an electrically conductive terminal related to the present invention.
Figure 9:
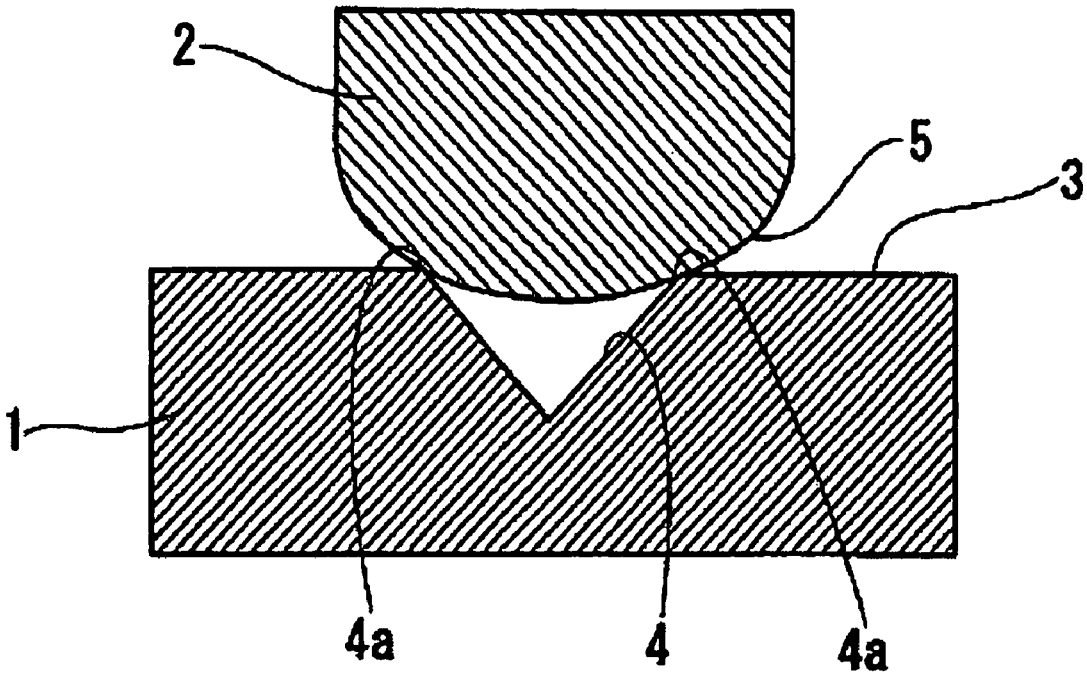
Figure 9 (Prior Art)
FIG. 9 is a major portion cross-sectional diagram showing a conventional electrically conductive terminal.

Furthermore, in the application example mentioned previously, the edge section (20*a*) for the enhancement of the wiping effect is formed from a groove (20). However, the present invention is not to be restricted to the application example mentioned previously. Instead of a groove for the edge section (20*a*), a long hole having the same cross-sectional shape as the groove as shown in FIG. 8 is also acceptable. Furthermore, long holes in the roulette shape shown in FIG. 7 are also acceptable, and the shape is not restricted.

As explained previously, the present invention is appropriate for the connecting terminal of an electric connector having a low manufacturing cost and being capable of achieving stable electric connection characteristics.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

The invention claimed is:

1. A connecting terminal of an electric connector having a plug connector and a receptacle connector comprising:

an electrically conductive terminal consisting of a flat plate for connection of a substrate and another substrate or a cable and a substrate in at least one connector of the both connectors;

a bent convex section being subjected at a part of the connecting section of the electrically conductive terminal to a bending deformation into a convex shape from the backside toward the surface side;

a groove being provided in the center of the convex surface of the bent convex section to have a pair of opposed side walls between which the distance is gradually and continuously enlarged from the bottom to the opening; and edge sections being formed on both sides of the groove to scratch the surface of the counterpart connecting section for removing foreign substances;

wherein the distance between the opposed side wall pair of the groove constitutes the maximum width in about the middle portion of the longitudinal direction of the groove, and the distance is gradually reduced toward the both end portions according to the variation of the angle of the opposed side wall pair.

2. The connecting terminal of an electric connector described in claim 1, wherein the groove is formed so that a straight-line shape is obtained on the surface of the connecting section.

3. The connecting terminal of an electric connector described in claim 1, wherein the groove is formed so that a connected cross shape is obtained on the surface of the connecting section.

4. The connecting terminal of an electric connector described in claim 1, wherein the groove is formed so that a roulette shape is obtained on the surface of the connecting section.

* * * * *